US006133532A

United States Patent [19]

Lundbäck et al.

[11] Patent Number: 6,133,532

[45] Date of Patent: Oct. 17, 2000

[54] CONTACT DEVICE

[75] Inventors: Hans Lundbäck, Markaryd; Per Thorsson, Lövestad, both of Sweden

[73] Assignee: Teracom Components AB, Horby, Sweden

[21] Appl. No.: 09/248,505

[22] Filed: Feb. 10, 1999

[30] Foreign Application Priority Data

Feb. 17, 1998 [SE] Sweden ..... 9800448

[51] Int. Cl.[7] ..... H01R 9/07

[52] U.S. Cl. ..... 174/88 C; 439/578

[58] Field of Search ..... 174/88 C, 102 R, 174/84 R, 84 S; 439/578, 583, 584, 585, 427

[56] References Cited

U.S. PATENT DOCUMENTS

| | | | |
|---|---|---|---|
| 5,137,470 | 8/1992 | Doles | 439/578 |
| 5,518,420 | 5/1996 | Pitschi | 439/578 |
| 5,795,188 | 8/1998 | Harwath | 439/583 |
| 5,938,474 | 8/1999 | Nelson | 439/583 |
| 5,980,315 | 11/1999 | Matsuda et al. | 439/583 |
| 5,984,723 | 11/1999 | Wild | 439/583 |

*Primary Examiner*—Kristine Kincaid
*Assistant Examiner*—Chau N. Nguyen
*Attorney, Agent, or Firm*—McCormick, Paulding & Huber LLP

[57] ABSTRACT

A contact device for high-frequency cables including a front member (11) and a rear member (10). The rear member (10) is mounted on the high-frequency cable (1) and the front member (11) is brought in contact with an outer conductor (3) and an inner conductor (5) on the high-frequency cable (1) for transmission of high-frequency signals from the outer and inner conductor (3, 5) to the front member (11). The front member (11) and the rear member (10) are joined to a connector unit (42) in which the front member (11) and the rear member (10) are joined to a connector unit (42) in which the front member (11) is situated in a ready position (P) relative to the rear member (10), the said connector unit (42) can be mounted on the high-frequency cable (1) such that the cable (1) protrudes into the rear member (10). The front member (11) includes a forming and contact section (30) which, when the front member (11) is displaced from its ready position (P) toward its operating position (T), forms an outer collar (9) of the outer conductor (3) of the high-frequency cable (1) such that the outer collar (9) gains contact with the forming and contact section (30). The front member (11) further includes a displacement section (33) which displaces a retaining ring (27) from a ready position (E) to an operating position (F). In the latter position, the ring (27) retains the outer collar (9) on the outer conductor (3) of the cable (1) in contact with the forming and contact section (30) of the front member (11).

14 Claims, 5 Drawing Sheets

CONTACT DEVICE

BACKGROUND OF THE INVENTION

The present invention relates to a contact device for high-frequency cables, which contact device comprises a front member and a rear member, whereby said rear member is adapted for mounting on the high-frequency cable and whereby said front member is adapted for being brought in contact with an outer conductor and an inner conductor on the high-frequency cable for transmission of high-frequency signals from the outer and inner conductor to the front member.

Contact devices of the abovementioned type have a separate rear member and a separate front member. Initially, the rear member is mounted on the high-frequency cable and the outer collar of the outer conductor of said high-frequency cable is flared out by means of a special tool for fitting to a contact member on the front member when said front member is mounted on the rear member. Then, the front member is screwed onto the rear member until the contact member of the front member is brought in contact with the outer collar of the outer conductor.

There are some drawbacks in connection with said mounting procedure. Thus, a special tool is required for flaring out the outer collar on the outer conductor of the high-frequency cable and professional skill is also required if this flaring out shall be done in a satisfactory manner. Furthermore, several separate members must be handled during mounting, namely a rear member, a front member and a tool, which can be difficult particularly in bad weather conditions at high altitudes.

SUMMARY OF THE INVENTION

The object of the present invention is to eliminate these drawbacks and this is done by providing the contact device with the characterizing features of preliminary subsequent claim 1.

By providing the contact device with said characterizing features, said contact device can be mounted as a single connector unit and the additional working moment of flaring out the outer collar of the outer conductor of the high-frequency cable by means of a special tool is no longer required.

The depending claims define modified embodiments of the contact device of FIG. 1.

BRIEF DESCRIPTION OF THE DRAWING

The invention will be further described below with reference to the accompanying drawings, wherein.

DETAILED DESCRIPTION OF THE INVENTION

Figure 1:
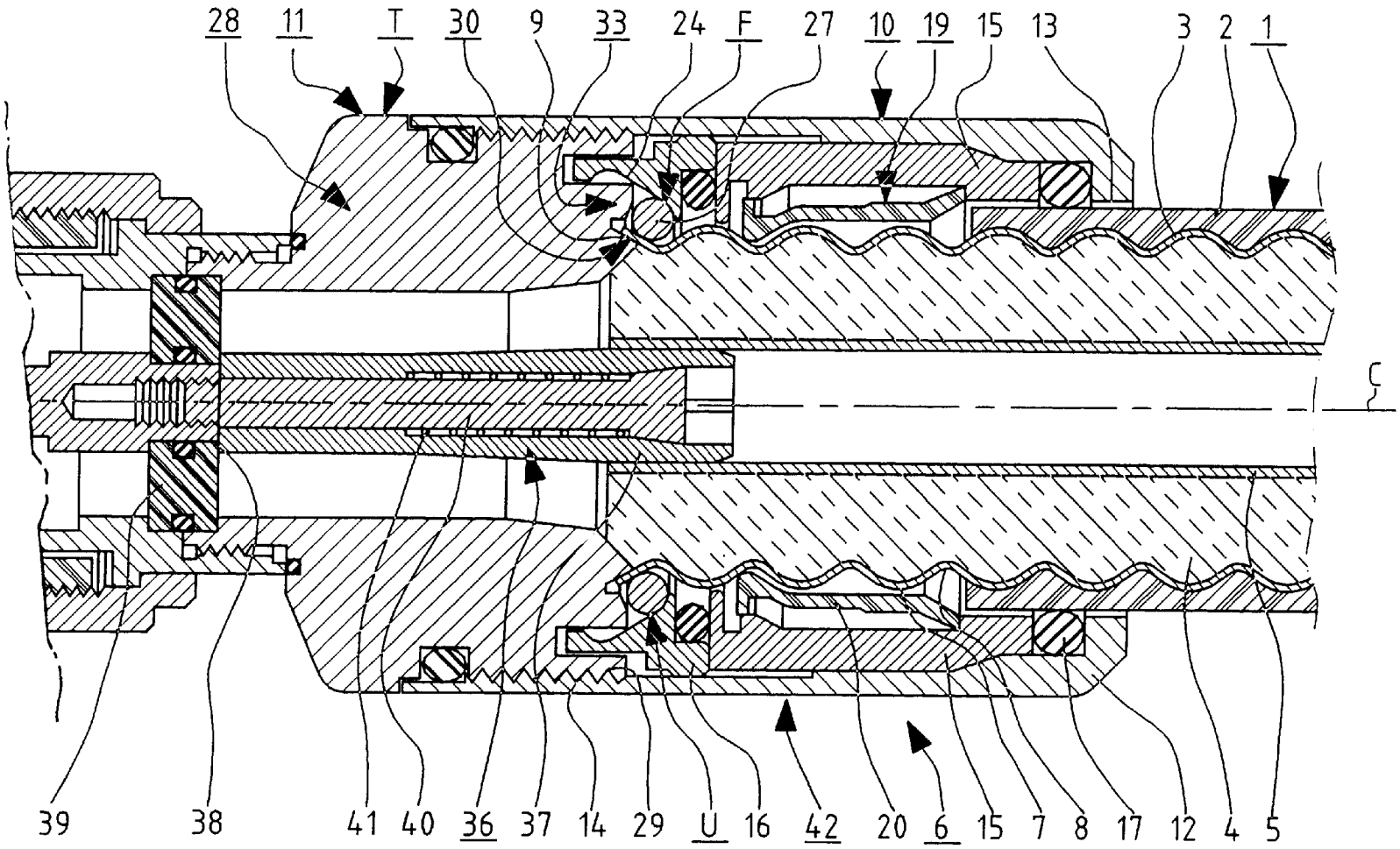
FIG. 1 is a longitudinal section through a contact device according to the invention.

In FIG. 1 there is illustrated a high-frequency cable 1 including a plastic coating 2, an outer conductor 3 provided within said coating, a plastic foam body 4 located within said outer conductor and an inner conductor 5 within said plastic foam body.

For mounting a contact device 6 on this high-frequency cable 1, the plastic coating 2 is removed from an end portion of said high-frequency cable 1, so that the outer conductor 3 is not covered by said plastic coating 2 along said end portion.

The outer conductor 3 of the high-frequency cable 1 is "corrugated" and includes alternating wave crest portions 7 and wave trough portions 8 and the high-frequency cable 1 is cut such that an outer collar 9 of the outer conductor 3 constitutes about half a wave crest portion 7.

The contact device 6 is adapted to provide high-frequency contact between the outer and inner conductors 3, 5 of the high-frequency cable 1 and members of other equipment (not shown) in a high-frequency system. The contact device 6 comprises a rear member 10 and a front member 11. The rear member 10 has an outer sleeve 12 with a rear hole 13 for the high-frequency cable 1 and with inner threads 14 for the front member 11 at the front. Inside the outer sleeve 12 there is provided a rear inner sleeve 15 and a front inner sleeve 16. Between rear portions of the rear inner sleeve 15 and the outer sleeve 12 there is located a sealing ring 17 for providing a sealing between the plastic coating 2 of the high-frequency cable 1 and the rear member 10. Between the rear and front inner sleeves 15, 16 there is located another sealing ring 18 for providing a sealing between the rear member 10 and the outer conductor 3.

Figure 3:
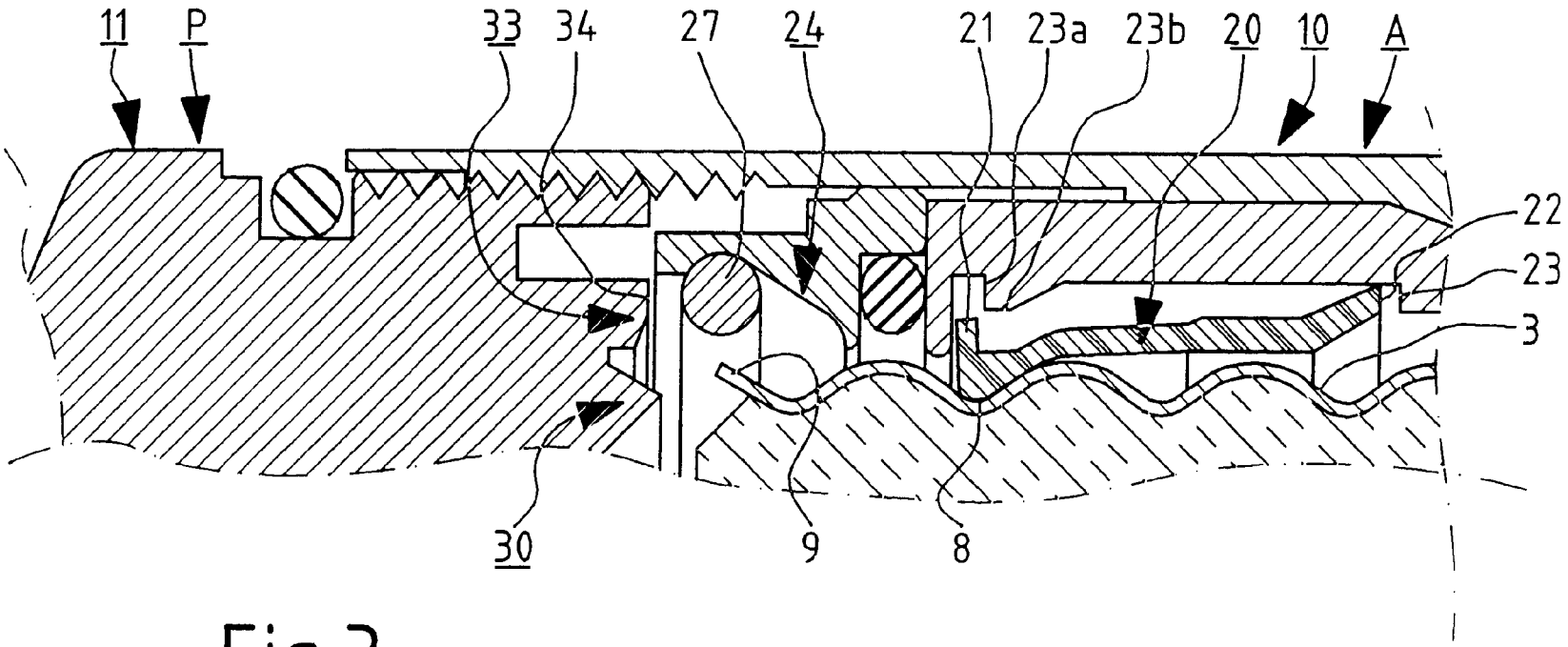
FIG. 3 illustrates said parts of the contact device of FIG. 1 in a second position during its mounting on the high-frequency cable.
Figure 4:
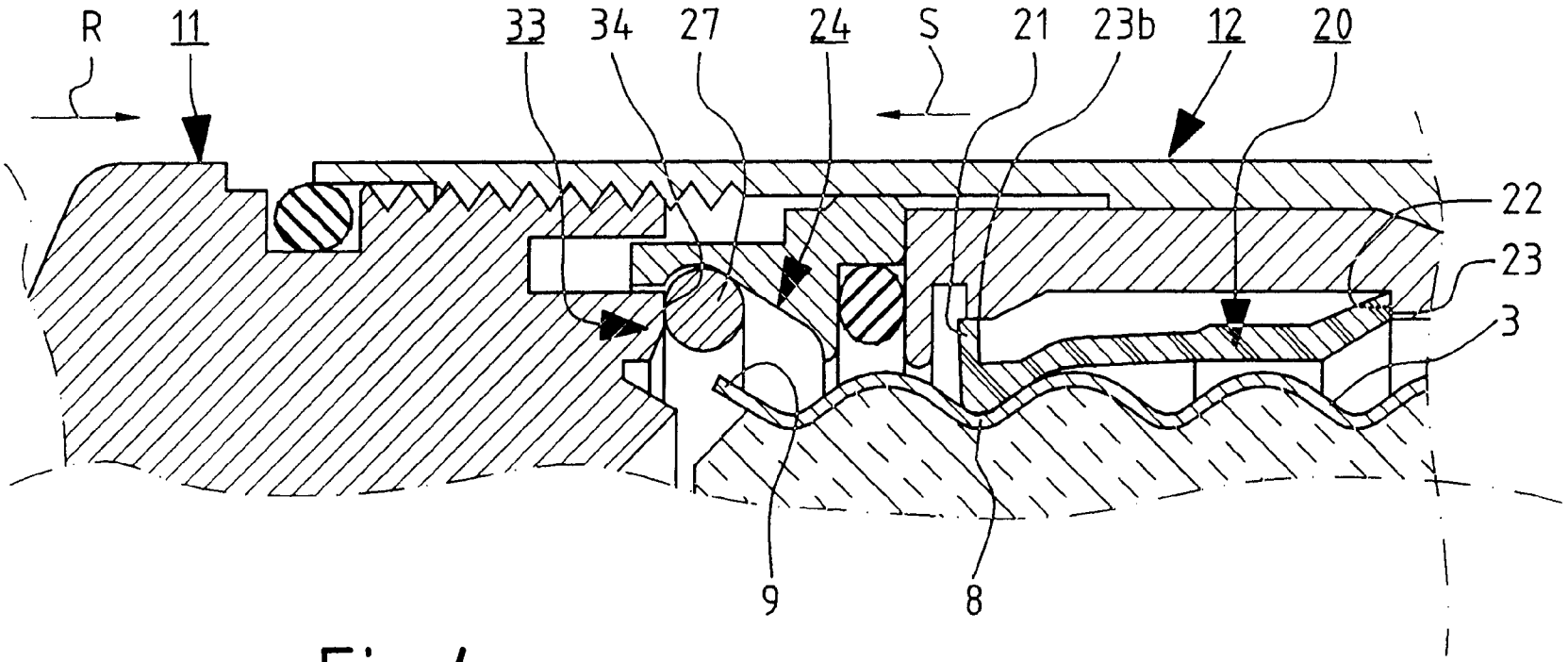
FIG. 4 illustrates said parts of the contact device of FIG. 1 in a third position during its mounting on the high-frequency cable.
Figure 5:
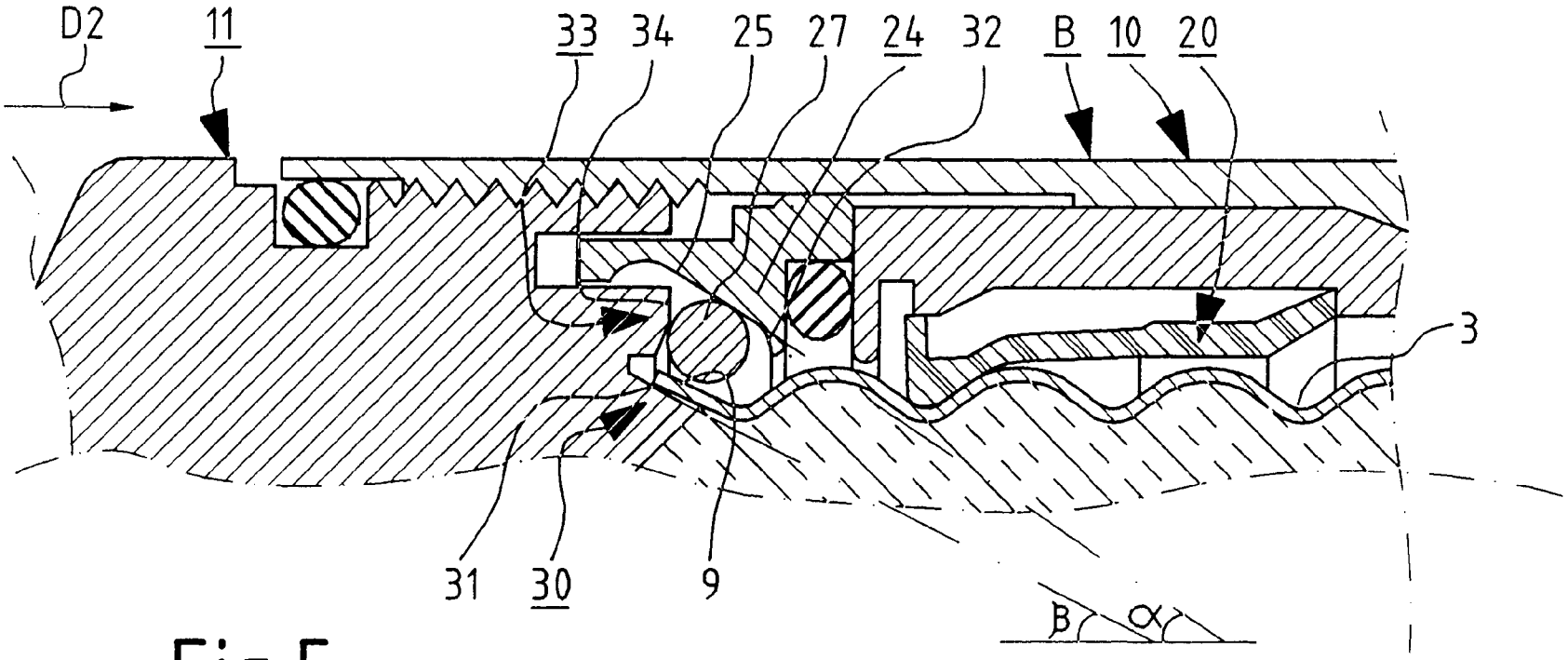
FIG. 5 illustrates said parts of the contact device of FIG. 1 in a fourth, almost finished mounting position during its mounting on the high-frequency cable.

The rear member 10 includes a locking device 19 for locking said rear member 10 to the high-frequency cable 1. The locking device 19 comprises in the embodiment shown a lock member 20 which is located in the rear inner sleeve 15 of the rear member 10 and which is slotted in parallel with a centre line C extending axially through the contact device 6. The lock member 20 has such resilient properties that it can spring in radial direction relative to said centre line C. The lock member 20 also has a front locking portion 21 and a rear locking portion 22. The front locking portion 21 can move into a groove 23*a* in the rear inner sleeve 15 such that the lock member 20 can spring in radially outwards direction when the rear member 10 takes up a rear position A relative to said lock member 20 (see FIG. 3). The front locking portion 21 can be blocked by a blocking portion 23*b* located behind the groove 23*a* on the rear inner sleeve 15, such that the lock member 20 is prevented from springing radially outwards when the rear member 10 is situated in a front position B relative to said lock member 20 (see FIG. 4).

When the rear member 10 is situated in its rear position A, the rear locking portion 22 will be located in front of a support portion 23 of the rear inner sleeve 15 and when said rear member 10 is in its front position B, the rear locking portion 22 is brought in contact with said support portion 23.

The object of the abovementioned construction of the rear inner sleeve 15 and lock member 20 is that said lock member 20 shall permit threading of the rear member 10 onto a high-frequency cable (or insertion of said high-frequency cable 1 into said rear member 10). Hereby, the wave crest portions 7 of the outer conductor 3 will bring the front locking portion 21 of the lock member 20 to spring radially outwards and said locking portion will slide into the groove 23*a*. When the wave crest portion 7 has passed the front locking portion 21, said locking portion will spring radially inwards into the following wave trough portion 8 and slide out of said groove 23*a*. When the front locking portion 21 of the lock member 20 is situated in the second wave trough portion 8 counted in backwards direction from the outer collar 9 and the rear member 10 is moved in axial direction S forward from its rear position A to its front position B, the support portion 23 is brought in contact with the rear locking portion 22 of the lock member 20 and the blocking portion 23*b* will be situated in a blocking position in which it prevents the front locking portion 21 from springing out from the wave trough portion 8. This means that the lock member 20 will lock the rear member 10 when said rear member has been brought to its front portion B such that said rear member can not be pulled further in forward direction relative to the high-frequency cable 1.

The front inner sleeve 16 of the rear member 10 has a guide surface 24 which is conically tapering in backwards direction relative to the rear member 10. The guide surface 24 has a front portion 25 which has a greater diameter than a rear portion 26 thereof.

A retaining means 27 in the shape of a ring of plastic material is situated in a ready position E (see FIG. 2) in the front portion 25 of the guide surface 24, i.e. where said guide surface 24 has its largest diameter. This ring 27 is adapted to be pressed backwards to an operating position F (see FIG. 1) at the rear portion 26 of the guide surface 24. During this movement the ring is loaded such that its diameter is successively decreased so that it has a substantially smaller diameter in the operating position F than in the ready position E.

The front member 11 comprises a cylindrical section 28 having such outer threads 29 which fit into the inner threads 14 of the rear member 10 such that said front member 11 can be screwed into said rear member 10 in a direction K backwards (see FIG. 2) from a ready position P to an operating position T relative to said rear member 10.

The front member 11 comprises a forming and contact section 30 with a contact surface 31 for engagement by the outer collar 9 of the outer conductor 3. The forming and contact section 30 is pointed such that it can be inserted between the plastic foam body 4 and the outer collar 9 and thereby form said outer collar 9 so that said outer collar extends along the contact surface 31. The guide surface 24 as well as the contact surface 31 form acute angles $\alpha$ and $\beta$ with the centre line C, whereby the angle $\alpha$ of the guide surface 24 is larger than the angle $\beta$ of the contact surface 31. Hereby, a space 32 for the ring 27 which tapers in backwards direction relative to the rear member 10 is defined between the guide surface 24 and the contact surface 31 such that said ring 27 is compressed when it is moved from its ready position E to its operating position F. The angle $\alpha$ can e.g. be 1–10° larger than the angle $\beta$.

The front member 11 comprises a displacement section 33 having an outer portion 34 and adapted to move the retaining means 27 from its ready position E to its operating position F. The outer portion 35 of the forming and contact section 30 is located closer to the outer collar 9 than the outer portion 34 of the displacement section 33 such that said forming and contact section 30 has finished forming the outer collar 9 before said displacement section 33 moves the retaining means 27 to its operating position F.

Figure 2:
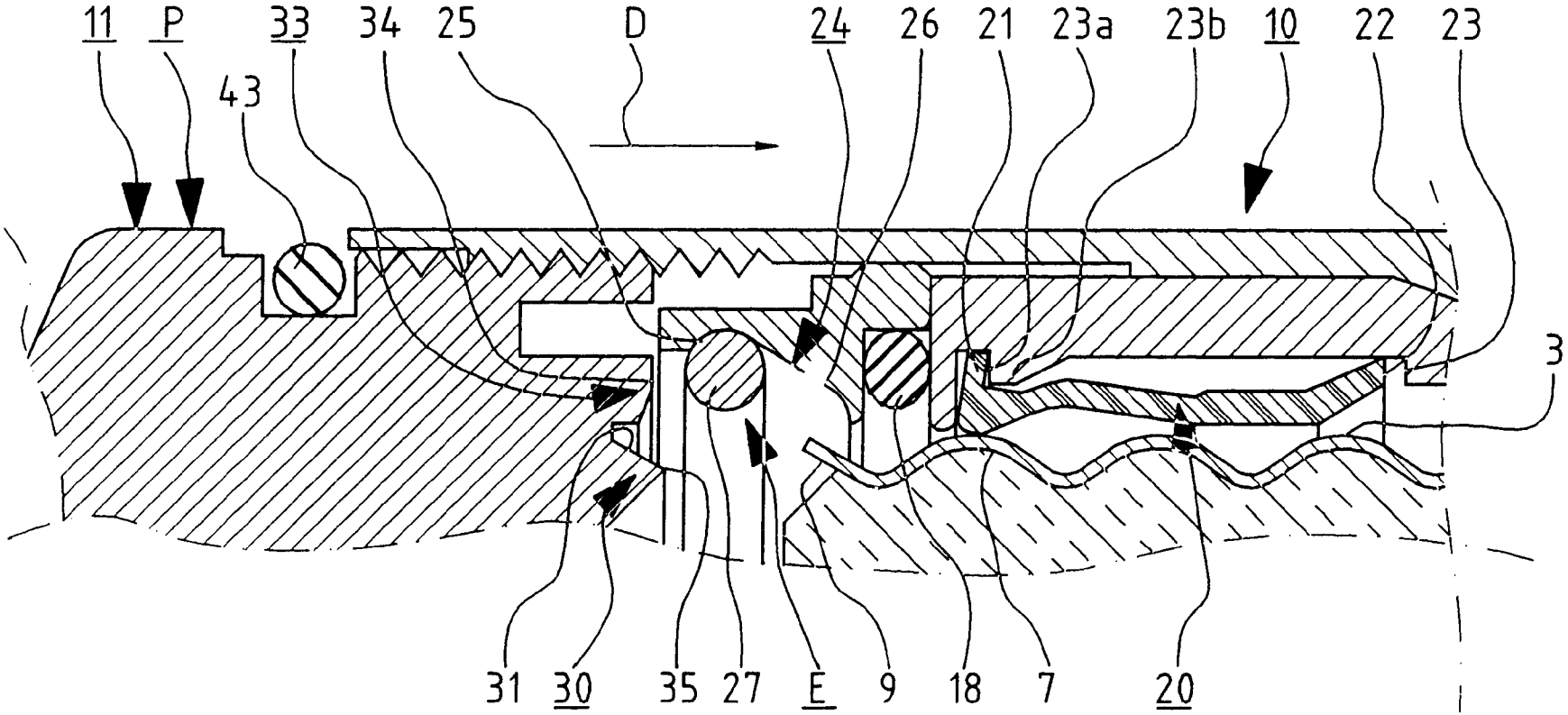
FIG. 2 illustrates parts of the contact device of FIG. 1 in an initial first position during its mounting on a high-frequency cable.

Before mounting on the high-frequency cable 1, the front and rear members 10, 11 are screwed together to a connector unit 42 in which the front member 11 is in operating position P relative to the rear member 10 (see FIG. 2). Then, the connector unit 42 is moved in backwards direction D on the high-frequency cable 1 or said high-frequency cable 1 is inserted into said connector unit 42. Thereafter, the front member 11 is screwed in a backwards direction R relative to the rear member 10, whereby the forming and contact section 30 slides in between the plastic foam body 4 and the outer collar 9 and the outer portion 34 of the displacement section 33 is brought in contact with the retaining means 27 and starts to displace or move said retaining means in backwards direction from its ready position E. Because of the resistance thereby applied to the front member 11, it pulls the rear member 10 in forward direction S until the locking device 19 locks said rear member 10 to the high-frequency cable 1.

When the front member 11 is screwed further in direction R towards the rear member 10, the displacement section 33 will press or push the retaining means 27 in backwards direction along the guide surface 24 and when the front member 11 is in an operating position T relative to the rear member 10, the displacement section 33 will have moved the retaining means 27 to an operating position U. In this position, the displacement section 33 will press the retaining means 27 against the outer collar 9 which in turn is pressed against the contact surface 31 of the forming and contact section 30. When the front member 11 is situated in said operating position U, the displacement section 33 will retain the retaining means 27 in its said operating position U.

In the ready position E, the retaining means 27 has an inner diameter which is larger than an outer diameter of the outer collar 9 and it is subjected to plastic deformation when it is moved from its ready position E to its operating position F, in which said retaining means 27 has an inner diameter which is smaller than an outer diameter of the outer collar 9.

The front member 11 also has an inner conductor 36 which is adapted to protrude into the tubular inner conductor 5 of the rear member 10 when said front member 11 is in its operating position T relative to said rear member 10. The inner conductor 36 has an expandable member 37 which at the front is provided with grip portions 38 which can be brought to grip into a support member 39. Inside the expandable member 37 there is provided a screw means 40 and a spring means 41 which press the expandable member 37 in a direction towards the support member 39 such that the grip portions 38 grip into said support member. By driving the screw means 40 in forward direction, the expandable member 37 is expanded in radial direction relative to the centre line C until said expandable member is contacting the tubular inner conductor 5. Since the spring means 41 thereby brings the grip portions 38 of the expandable member 37 to grip into the support member 39, said expandable member 37 is prevented from rotating when the screw means 40 is driven in forward direction.

The contact device according to the invention is not limited to the embodiment described above, but may vary within the scope of the subsequent claims. Thus, the rear member 10 and the front member 11 may e.g. be attached to each other in other ways than through threads 14 and 29, the rear member 10 may consist of one section instead of three, the locking device 19 may be of another type than the one described, the retaining means 27 can be displaced in another way along the described guide surface 24 from its ready position E to its operating position F, the retaining means 27 may be a ring of copper material or another suitable material and there may be a sealing ring 43 between the front member 11 and the rear member 10.

What is claimed is:

1. Contact device for high-frequency cables, said contact device comprising a front member (11) and a rear member (10), whereby said rear member (10) is adapted for mounting on a high-frequency cable (1) and whereby said front member (11) is adapted for being brought in contact with an outer conductor (3) and an inner conductor (5) of the high-frequency cable (1) for transmission of high-frequency signals from the outer and inner conductor (3, 5) to the front member (11), characterized in, that the front member (11) and the rear member (10) are joined together to a connector unit (42) in which said front member (11) is situated in its ready position (P) relative to said rear member (10), whereby said connector unit (42) can be mounted on the high-frequency cable (1) such that said high-frequency cable (1) protrudes into the rear member (10), that the front member (11) is displaceably or movably mounted relative to said rear member (10) from the ready position (P) to its operating position (T), that the rear member (10) comprises at least one locking device (19) for locking said rear member (10) relative to the high-frequency cable (1) when said cable (1) protrudes into said rear member (10), that the front member (11) comprises at least one forming and contact section (30) which, when said front member (11) is displaced or moved from its said ready position (P) towards its said operating position (T), is provided to contact an outer collar (9) of the outer conductor (3) of the high-frequency cable (1) such that said outer collar (9) gains contact with the forming and contact section (30), and that the front member (11) further comprises at least one displacement section (33) which is provided to displace or move at least one retaining means (27) from a ready position (E) to its operating position (F) in which said retaining means (27) retains the outer collar (9) of the outer conductor (3) of the high-frequency cable (1) in contact with the forming and contact section (30) of the front member (11), the retaining means (27) cooperating with a surface (24) on the rear member (10), which guides the retaining means (27) when it is moved by the displacement section (33) from its said ready position (E) to its said operating position (F).

2. Contact device according to claim 1, characterized in that the guide surface (24) tapers conically in backwards direction relative to the rear member (10), that the retaining means (27) in its said ready position (E) is situated at a front portion (25) of the guide surface (24) where the diameter of said guide surface (24) is largest and that the retaining means (27) is displaceable or movable in backwards direction relative to the rear member (10) during decrease of the diameter of the retaining means (27) until said means (27) is situated at a rear portion (26) of the guide surface (24) in its said operating position (F) in which said retaining means (27) has a smaller diameter than when situated in said ready position (E).

3. Contact device according to claim 1, characterized in that the guide surface (24) is oriented such that an acute angle ($\alpha$) between said guide surface (24) and a centre line (C) of the connector unit (42) is larger than an acute angle ($\beta$) between a contact surface (31) on the forming and contact section (30) and said centre line (C), such that a space (32) for the retaining means (27) becomes more and more narrow in backwards direction relative to the rear member (10).

4. Contact device according to claim 1, characterized in that the guide surface (24) is oriented such that the acute angle ($\alpha$) between said surface (24) and the centre line (C) is 1–10° larger than the acute angle ($\beta$) between the forming and contact section (30) and said centre line (C).

5. Contact device according to claim 1, whereby the outer conductor (3) has such a corrugated shape that it includes successive wave crest portions (7) and wave trough portions (8) and whereby the outer collar (9) is a part of said wave crest portions (7), characterized in that the retaining means (27) in its said operating position (F) is situated close to one of said wave trough portions (8) immediately behind said outer collar (9).

6. Contact device for high-frequency cables, said contact device comprising a front member (11) and a rear member (10), whereby said rear member (10) is adapted for mounting on a high-frequency cable (1) and whereby said front member (11) is adapted for being brought in contact with an outer conductor (3) and an inner conductor (5) on the high-frequency cable (1) for transmission of high-frequency signals from the outer and inner conductor (3, 5) to the front member (11), characterized in, that the front member (11) and the rear member (10) are joined together to a connector unit (42) in which said front member (11) is situated in a ready position (P) relative to said rear member (10), whereby said connector unit (42) can be mounted on the high-frequency cable (1) such that said high-frequency cable (1) protrudes into the rear member (10), that the front member (11) is displaceably or movably mounted relative to the rear member (10) from the ready position (P) to an operating position (T), that the rear member (10) comprises at least one locking device (19) for locking said rear member (10) relative to the high-frequency cable (1) when said cable (1) protrudes into said rear member (10), that the front member (11) comprises at least one forming and contact section (30) which, when said front member (11) is displaced or moved from its ready position (P) towards its operating position (T), is provided to form an outer collar (9) of the outer conductor (3) of the high-frequency cable (1) such that said outer collar (9) gains contact with the forming and contact section (30), and that the front member (11) further comprises at least one displacement section (33) which is provided to displace or move at least one retaining means (27) from a ready position (E) to an operating position (F) in which said retaining means (27) retains the outer collar (9) on the outer conductor (3) of the high-frequency cable (1) in contact with the forming and contact section (30) of the front member (11), the retaining means (27) consisting of a ring of plastic material which in its said operating position (F) surrounds the outer collar (9) of the outer conductor (3), that the ring (27) in the ready position (E) has an inner diameter which is larger than an outer diameter of the outer collar (9) and the ring (27) is subjected to plastic deformation when it is moved from its said ready position (E) to its said operating position (F) in which said inner diameter is smaller than said outer diameter of the outer collar (9).

7. Contact device according to claim 6, characterized in that the ring (27) consists of copper material.

8. Contact device for high-frequency cables, said contact device comprising a front member (11) and a rear member (10), whereby said rear member (10) is adapted for mounting on a high-frequency cable (1) and whereby said front member (11) is adapted for being brought in contact with an outer conductor (3) and an inner conductor (5) on the high-frequency cable (1) for transmission of high-frequency signals from the outer and inner conductor (3, 5) to the front member (11), characterized in, that the front member (11) and the rear member (10) are joined or put together to a connector unit (42) in which said front member (11) is situated in a ready position (P) relative to said rear member (10), whereby said connector unit (42) can be mounted on the high-frequency cable (1) such that said high-frequency cable (1) protrudes into the rear member (10), that the front member (11) is displaceably or movably mounted relative to the rear member (10) from the ready position (P) to an operating position (T), that the rear member (10) comprises at least one locking device (19) for locking said rear member (10) relative to the high-frequency cable (1) when said cable (1) protrudes into said rear member (10), that the front member (11) comprises at least one forming and contact section (30) which, when said front member (11) is displaced or moved from its ready position (P) towards its operating position (T), is provided to form an outer collar (9) of the outer conductor (3) of the high-frequency cable (1) such that said outer collar (9) gains contact with the forming and contact section (30), and that the front member (11) further comprises at least one displacement section (33) which is provided to displace or move at least one retaining means (27) from a ready position (E) to an operating position (F) in which said retaining means (27) retains the outer collar (9) on the outer conductor (3) of the high-frequency cable (1) in contact with the forming and contact section (30) of the front member (11), the outer conductor (3) has such a corrugated shape that it forms successive wave crest portions (7) and wave trough portions (8), characterized in that the locking device (19) for locking the rear member (10) relative to the high-frequency cable (1) comprises at least one lock member (20) with resilient properties in a radial direction relative to a center line (C) running axially through the contact device, that the lock member (20) has a front locking portion (21) which because of the resilient properties of the lock member (20) in the radial direction is brought to spring in a radially outward direction when one of said wave crest portions (7) of the outer conductor (3) passes said front locking portion (21) and in a radially inwards direction when one of said wave trough portions (8) passes said front locking portion (21) when the rear member (10) is threaded onto the high-frequency cable (1) or said high-frequency cable (1) is inserted into said rear member (10), that the front locking portion (21) in a locking position engages said one of the wave trough portions (8) of the outer conductor (3), that the lock member (20) further comprises a rear locking portion (22) which is set in a position in front of a support portion (23) of the rear member (10) when said rear member (10) is situated in a rear position (A), that the rear member (10) is provided for displacement or movement in axially forward direction (S) relative to the lock member (20) by influence thereof in said direction by the front member (11) when said front member is moved from its said ready position (P) towards its said operating position (T), that the lock member (20) limits said movement of the rear member (10) in said forward direction (S) by bringing the support portion (23) of the rear member (10) in contact with the rear locking portion (21) of the lock member (20), that the rear member (10) has a blocking portion (23*b*) which through said movement of the rear member (10) in said forward direction (S) relative to the lock member (20) is brought to a blocking position in which it blocks or prevents the front locking portion (21) of the lock member (20) from leaving said locking position at said one wave trough portion (8), whereby said lock member (20), while said front locking portion (21) is situated in said one wave trough portion (8) at the same time as the support portion (23) of the rear member (10) engages said rear locking portion (22), prevents displacement or movement of the rear member (10) in said axially forward direction (S) when the forming and contact section (30) is brought in contact with the outer collar (9) or the displacement section (33) contacts the retaining means (27) during movement of the front member (11) from its said ready position (P) to its said operating position (T).

9. Contact device according to claim 8, characterized in that the lock member (20) has the shape of a sleeve, surrounds the outer conductor (3), has resilient properties and is slotted in parallel with said centre line (C) running through the connector unit (42).

10. Contact device according to claim 8, characterized in that the front member (11) and rear member (10) are provided with mating threads (14, 29) which permit setting of the front member (11) in its said ready position (P) relative to the rear member (10) and displacement or movement of said front member (11) from its said ready position (P) to its said operating position (T) by screwing thereof relative to the rear member (10).

11. Contact device for high-frequency cables, said contact device comprising a front member (11) and a rear member (10), whereby said rear member (10) is adapted for mounting on a high-frequency cable (1) and whereby said front member (11) is adapted for being brought in contact with an outer conductor (3) and an inner conductor (5) on the high-frequency cable (1) for transmission of high-frequency signals from the outer and inner conductor (3, 5) to the front member (11), characterized in that the front member (11) and the rear member (10) are joined or put together to a connector unit (42) in which said front member (11) is situated in a ready position (P) relative to said rear member (10), whereby said connector unit (42) can be mounted on the high-frequency cable (1) such that said high-frequency cable (1) protrudes into the rear member (10), that the front member (11) is displaceably or movably mounted relative to the rear member (10) from the ready position (P) to an operating position (T), that the rear member (10) comprises at least one locking device (19) for locking said rear member (10) relative to the high-frequency cable (1) when said cable (1) protrudes into said rear member (10), that the front member (11) comprises at least one forming and contact section (30) which, when said front member (11) is displaced or moved from its ready position (P) towards its operating position (T), is provided to form an outer collar (9) of the outer conductor (3) of the high-frequency cable (1) such that said outer collar (9) gains contact with the forming and contact section (30), and that the front member (11) further comprises at least one displacement section (33) which is provided to displace or move at least one retaining means (27) from a ready position (E) to an operating position (F) in which said retaining means (27) retains the outer collar (9) on the outer conductor (3) of the high-frequency cable (1) in contact with the forming and contact section (30) of the front member (11), the front member (11) including a tap-formed inner conductor (36) which grips into the inner conductor (5) of the high-frequency cable (1), characterized in that the inner conductor (36) of the front member (11) has a member (37) which is expandable in the radial direction relative to a center line (C) which is directed axially relative to the connector unit (42), that the expandable member (37) grips into the inner conductor (5) of the high-frequency cable (1), that the inner conductor (36) of the front member (11) has a screw means (40) which grips into the expandable member (37) and that the screw means (40), by displacement or movement in axially forward direction relative to the front member (11), brings the expandable member (37) to expand in the radial direction relative to said center line (C) through the connector unit (42) until said expandable member (37) has gained contact with the inner conductor (5) of the high-frequency cable (1).

12. Contact device according to claim 11, characterized in that between the screw means (40) and the expandable member (37) there is provided a spring means (41) exerting a force on the expandable member (37) in a direction towards a support member (39) located in front of said expandable member (37) such that grip portions (38) on said expandable member (37) are brought to grip into the support member (39), whereby said support member (39) prevents rotation of said expandable member (37) together with the screw means (40) when said screw means (40) is driven in forward direction relative to the front member (11) for expansion of said expandable member (37).

13. Contact device according to claim 11, characterized in that the rear member (10) has a sealing ring (18) for providing a sealing between said rear member (10) and the outer conductor (3).

14. Contact device for high-frequency cables, said contact device comprising a front member (11) and a rear member (10), whereby said rear member (10) is adapted for mounting on a high-frequency cable (1) and whereby said front member (11) is adapted for being brought in contact with an outer conductor (3) and an inner conductor (5) on the high-frequency cable (1) for transmission of high-frequency signals from the outer and inner conductor (3, 5) to the front member (11), characterized in that the front member (11) and the rear member (10) are joined or put together to a connector unit (42) in which said front member (11) is situated in a ready position (P) relative to said rear member (10), whereby said connector unit (42) can be mounted on the high-frequency cable (1) such that said high-frequency cable (1) protrudes into the rear member (10), that the front member (11) is displaceably or movably mounted relative to the rear member (10) from the ready position (P) to an operating position (T), that the rear member (10) comprises at least one locking device (19) for locking said rear member (10) relative to the high-frequency cable (1) when said cable (1) protrudes into said rear member (10), that the front member (11) comprises at least one forming and contact section (30) which, when said front member (11) is displaced or moved from its ready position (P) towards its operating position (T), is provided to form an outer collar (9) of the outer conductor (3) of the high-frequency cable (1) such that said outer collar (9) gains contact with the forming and contact section (30), and that the front member (11) further comprises at least one displacement section (33) which is provided to displace or move at least one retaining means (27) from a ready position (E) to an operating position (F) in which said retaining means (27) retains the outer collar (9) on the outer conductor (3) of the high-frequency cable (1) in contact with the forming and contact section (30) of the front member (11), the rear member (10) having a sealing ring (17) which is located behind the sealing ring (18) between said rear member (10) and the outer conductor (3) for sealing between said rear member (10) and said high-frequency cable (1).

* * * * *